US005552026A

United States Patent [19]

Ikegaya et al.

[11] Patent Number: 5,552,026

[45] Date of Patent: Sep. 3, 1996

[54] SURFACE TREATMENT APPARATUS

[75] Inventors: Hirihiko Ikegaya; Masaaki Isobe; Masayuki Watanabe, all of Iwata, Japan

[73] Assignee: Yamaha Hatsudoki Kabushiki Kaisha, Iwata, Japan

[21] Appl. No.: 299,834

[22] Filed: Sep. 1, 1994

[30] Foreign Application Priority Data

Sep. 2, 1993 [JP] Japan ..... 5-218755
Jun. 16, 1994 [JP] Japan ..... 6-134714

[51] Int. Cl.[6] ..... C25D 17/00; C25D 17/06; B05C 3/02

[52] U.S. Cl. ..... 204/198; 204/224 R; 204/224 M; 204/272; 204/275; 204/297 R; 118/404; 118/410; 118/429

[58] Field of Search ..... 204/272, 224 R, 204/224 M, 275, 198, 297 R; 118/404, 410, 429

[56] References Cited

U.S. PATENT DOCUMENTS

| | | | |
|---|---|---|---|
| 3,138,483 | 6/1964 | Dettling et al. | 118/429 X |
| 3,841,990 | 10/1974 | Sasaki et al. | 204/272 X |
| 3,956,096 | 5/1976 | Paulson et al. | 204/272 X |
| 4,246,088 | 1/1981 | Murphy et al. | 204/272 X |
| 4,441,976 | 4/1984 | Iemmi et al. | 204/272 X |
| 4,705,611 | 11/1987 | Grimes et al. | 204/275 X |
| 5,002,649 | 3/1991 | Smith | 204/272 X |

FOREIGN PATENT DOCUMENTS

| | | |
|---|---|---|
| 2685924 | 1/1993 | France . |
| 3937763 | 1/1993 | Germany . |

OTHER PUBLICATIONS

European Search Report dated Dec. 27, 1994.
Patent Abstract of Japan, vol. 17, No. 678, Dec. 13, 1993 & JP–A–05 222 589 (Toyota Motor Corp).
Patent Abstract of Japan, vol. 10, No. 172, Jun. 18, 1986 & JP–A–61 23 785 (Kiyourkitsu K.K.).

*Primary Examiner*—Donald R. Valentine
*Attorney, Agent, or Firm*—Knobbe, Martens, Olson & Bear

[57] ABSTRACT

An improved surface treatment system, assembly, workstation and method for plating and the like. The assembly includes a suction pump along the treating liquid discharge end to circulate treatment fluid and avoid leakage. The assembly includes a member defining a fluid passage within the interior surface of a workpiece which is connected to a treating liquid feed channel and a treating liquid discharge channel. Advantageously, a washing fluid inlet is provided to permit a workpiece to be both treated and washed at the same workstation. The assembly may be used with a cover as an additional means to avoid leakage.

17 Claims, 16 Drawing Sheets

SURFACE TREATMENT APPARATUS

FIELD OF THE INVENTION

This invention relates to surface treatment methods and devices and, in particular, to such methods and devices used in the process of nickel plating the interior surfaces of cylinders of internal combustion engine blocks.

BACKGROUND OF THE INVENTION

Historically, plating processes were relatively slow and, therefore, were not possible in a general assembly line environment. Accordingly, parts to be plated were removed from the assembly line, transported to plating treatment locations and later retransported and replaced on the assembly line.

Recently, however, high speed plating methods have been developed. For example, Japanese Patent Publication No. 1-52,480 discloses a surface treatment device for degreasing the inside surface of the cylinder of an engine prior to chrome plating. During the process, both ends of the engine cylinder are plugged with a plug through a sealing material. One of the plugs defines a passage for the entry of treating liquid, while the other plug defines a treating liquid exit passage. Both passages are in fluid communication with the inside of the cylinder. A tank for the treating liquid, a pump, and valves are connected to a piping system for purposes of recirculating the treatment liquid from a treatment liquid reservoir through the engine cylinders and returning the treatment liquid to the reservoir. The flow of the treating liquid through the inside of the cylinder permits a higher current density to be applied to the liquid, resulting in higher plating rate.

On the other hand, this and other high speed plating devices have significant limitations. For example, in the above-described device, experience has shown that it is difficult to completely prevent the leakage of treating liquids from the inside of the cylinder. Specifically, due to the varying sizes of the walls of the crank chamber and their proximity to the cylinders being plated, it is difficult to properly seal the cylinders against leakage. Such leakage can adversely affect the quality of the plating of the cylinder, as well as result in the deposition of plating treatment liquid on the outside of the cylinder. It also poses a safety risk.

Thus, there is needed an improved surface treatment device and, in particular, an improved surface treatment device suitable for use in,plating the cylindrical walls of engine blocks.

SUMMARY OF THE INVENTION

Applicant's invention is an improved plating treatment system including an improved fluid transfer assembly and workstation, as well as an improved plating treatment method.

An important aspect of Applicant's invention is an assembly for treating an interior surface of a workpiece, including a body, a member, a treating liquid feed channel, a treating liquid discharge channel, and a suction pump. The body defines a support to which a workpiece is mountable. The member defines a fluid passage for treating liquid to flow within the interior surface of a workpiece mounted on the support. The fluid passage defines a treating liquid feed end and a treating liquid discharge end. The treating liquid feed channel is connected to the treating liquid end of the member, and the treating liquid discharge channel is connected to the treating liquid discharge end of the member. The suction pump is positioned along the treating liquid discharge channel to exert suction on liquid within the treating liquid discharge channel. Desirably, the assembly is used in connection with a workpiece defining a cylinder connecting a first opening and a second opening, wherein the support secures the workpiece in an orientation such that the cylinder is vertically oriented with the second opening located above the first opening and the member positioned within the cylinder.

Another aspect of the invention is an assembly for treating an interior surface of a workpiece, including a body, a member, a treating liquid feed channel, a treating liquid discharge channel, a source of pressure, and a washing fluid inlet. The body defines a support to which a workpiece is mountable. The member defines a fluid passage for treating liquid to flow within the interior surface of the workpiece mounted on the support. The fluid passage defines a treating liquid feed end and a treating liquid discharge end. The treating liquid feed channel is connected to the treating liquid feed end of the member. The treating liquid discharge channel is connected to the treating liquid discharge end of the member. The source of pressure communicates with one of the feed channel and the discharge channel to circulate liquid within the assembly. A washing fluid inlet communicates with the fluid passage to direct washing water against the interior surface of the workpiece.

DETAILED DESCRIPTION OF THE PREFERRED EMBODIMENT

Figure 1:
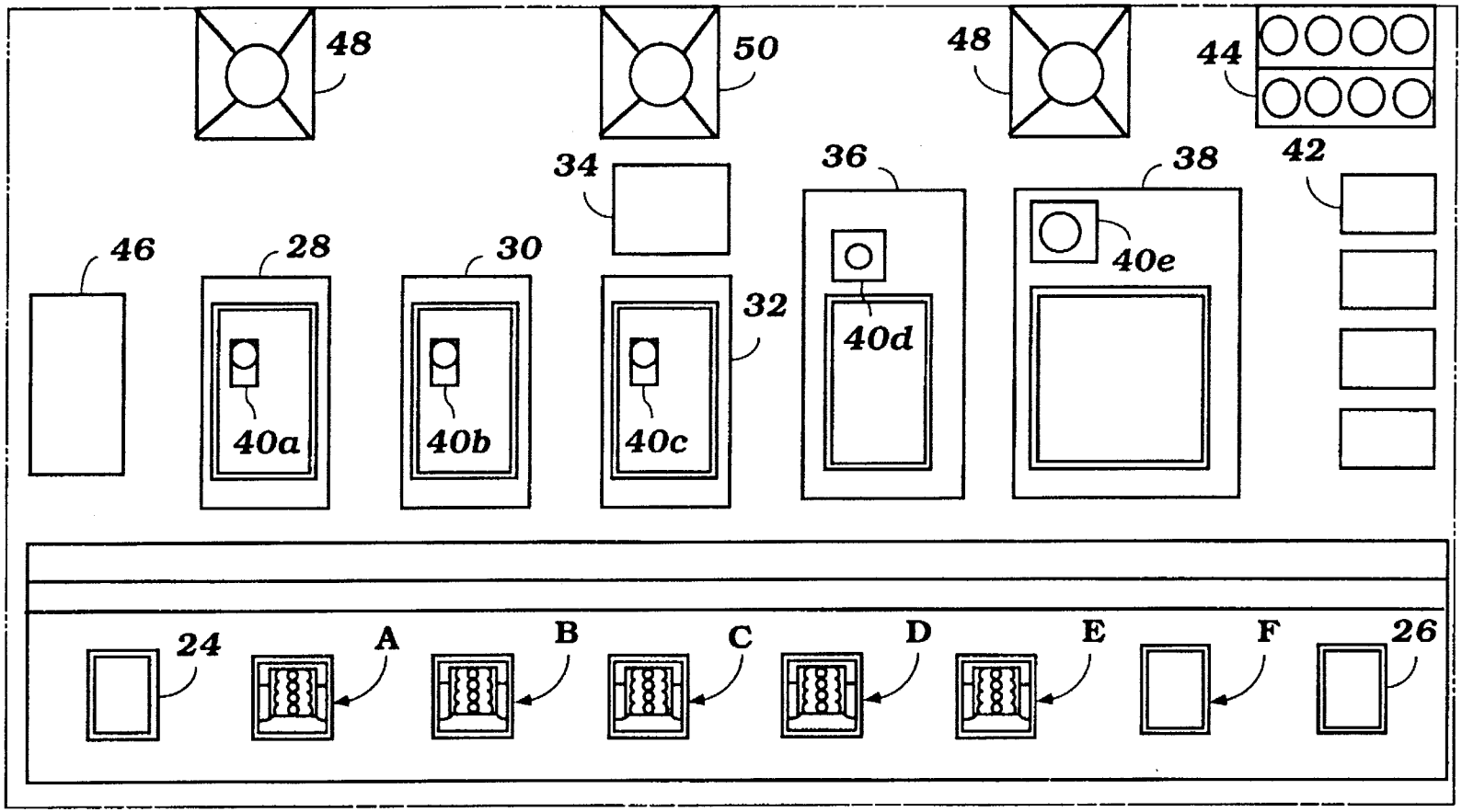
FIG. 1 is a plan view schematically illustrating the plating treatment system of the present invention.
Figure 2:
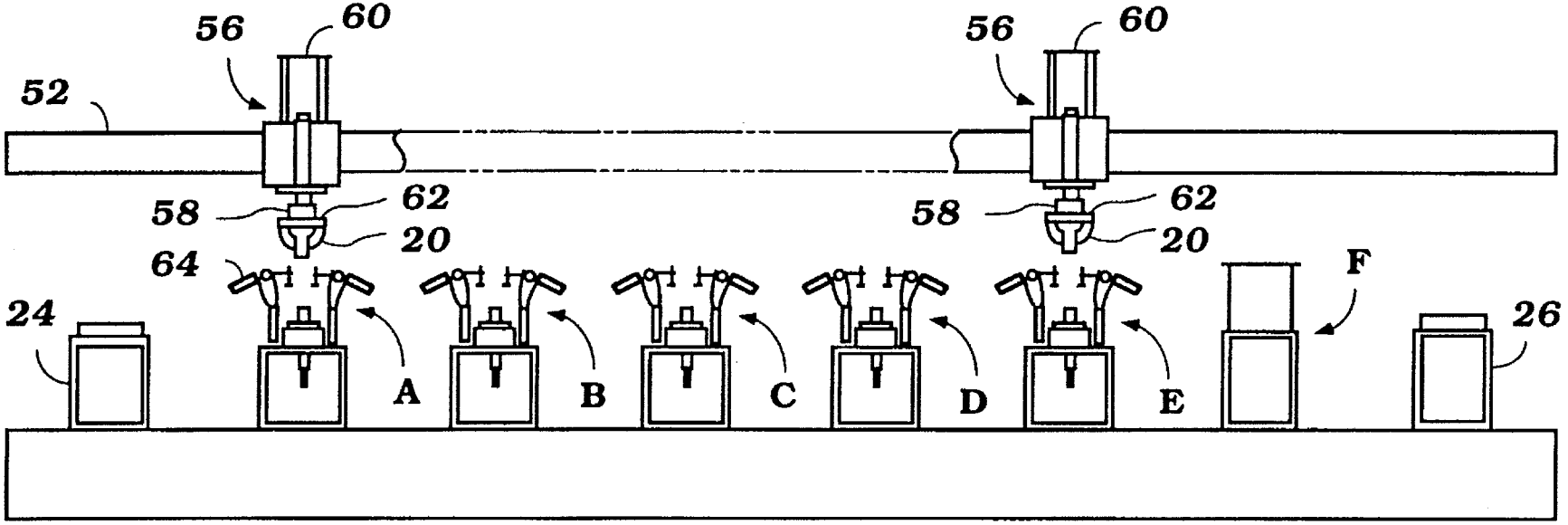
FIG. 2 is a schematic elevational view illustrating the plating treatment System of FIG. 1.

FIGS. 1 and 2 schematically illustrate the plating treatment system of the present invention in connection with a system for plating a cylinder block 20 having a plurality of cylinders 22 (FIG. 5), each of which defines an inner cylindrical surface which is to be plated. It will be appreciated, however, that the system, device, and method of the present inventions are not limited to use in plating cylinder blocks or the specific type of plating herein disclosed.

For purposes of clarity, an overview of the entire system will first be described. After this general framework is provided, the fluid transfer assembly which transfers liquid to and from each individual workstation will be described. The description will then focus on a individual plating workstation and general operation, as well as an individual pretreatment workstation. Thereafter, various alternative embodiments of the system, fluid transfer assembly and workstations will be discussed.

FIGS. 1–2 illustrate a system particularly adapted to perform a high speed plating process incorporating nickel and, as a dispersing agent, silicon carbide and phosphorous. This plating material is desirable for reasons of hardness and resistance to baking of the inside of the cylinder, as will be discussed below in,greater detail.

System Overview

The system utilizes a number of treatment workstations A–D for various pretreatments, a plating workstation E, and a drying workstation F. These workstations are positioned along a plating process assembly line in an order corresponding to the order in which the operations are performed. Specifically, the system incorporates a degreasing treatment workstation A, an alkali etching treatment workstation B, a mixed acid etching treatment workstation C, an alumite treatment workstation D, a high-speed plating workstation E, and a drying workstation F. Desirably, the line also includes a workpiece feeding workstation 24 at the beginning of the plating treatment line and a workpiece delivery workstation 26 at the end of the plating treatment line.

Desirably, the workstations A–E are connected to respective liquid storage reservoirs by appropriate fluid communication lines. Specifically, the treatment line is provided with a degreasing liquid storage tank 28, an alkali liquid storage tank 30, a mixed acid liquid storage tank 32, a mixed acid exhaust liquid tank 34, an alumite liquid storage tank 36, and a plating liquid storage tank 38. Treating liquid supply pumps 40*a–e* are desirably provided between respective treating liquid tanks 28–38 and the corresponding treatment workstations A–E. In addition, the treatment line is provided with rectifiers 42, an ion exchanger 44, a control panel 46, air exhaust fans 48, and a nitrogen oxide cleaner 50.

As seen in FIG. 2, a support shaft or beam 52 extends above a workpiece transfer line 54. A plurality of workpiece transporting devices 56 are movably mounted along the beam 52, each of which is provided with a vertically reciprocable chuck 58 and a device 60 for moving the chuck up and down. The transporting devices 56 are moved along the beam 52 by a drive motor (not shown). A jig 62 is mounted on each cylinder block 20 to facilitate the transfer of the jig and cylinder block by the transfer device 56.

Each of the workstations is further provided with a position-determining apparatus and clamp 64 to position and clamp the cylinder block 20 with respect to the workstation.

Fluid Transfer Assembly for Workstation

Figure 3:
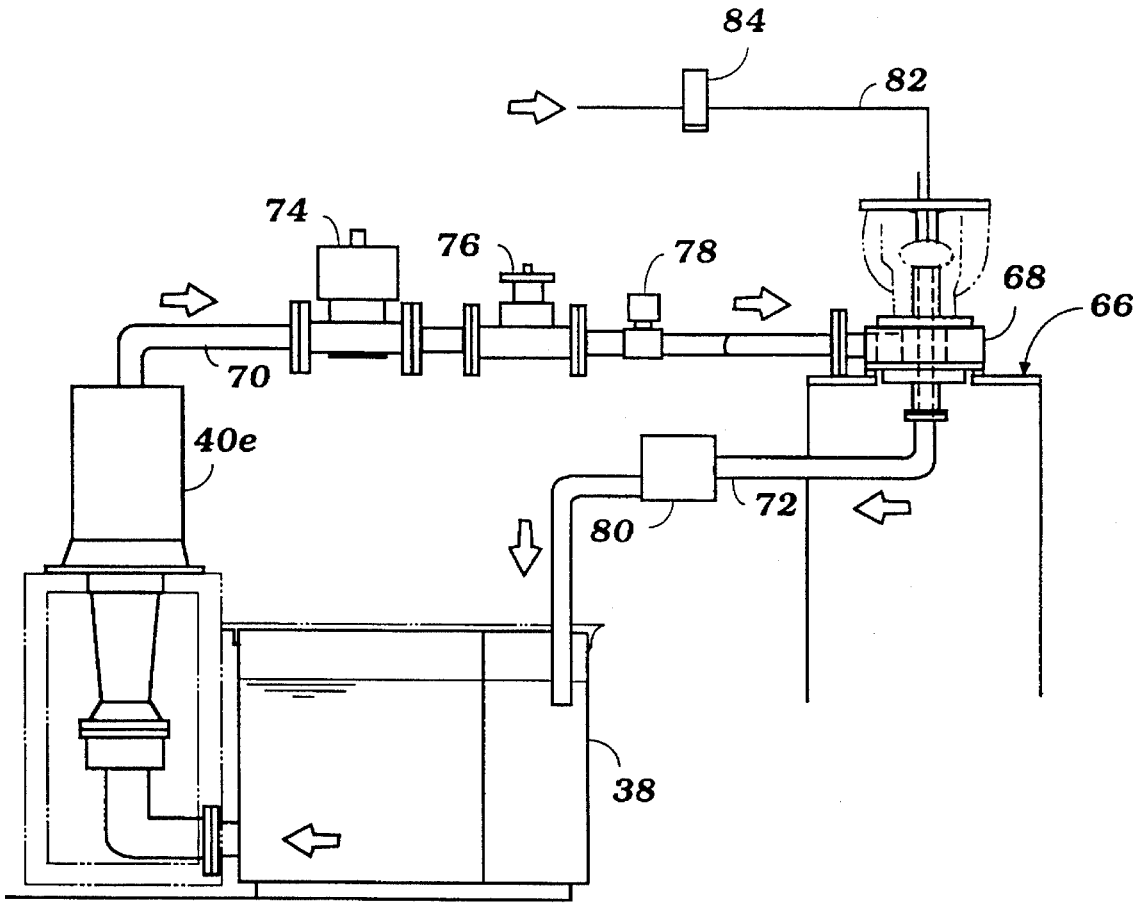
FIG. 3 is a schematic view illustrating the fluid transfer assembly of a plating workstation of the system of FIG. 1.

FIG. 3 schematically illustrates the fluid transfer assembly for a plating workstation. The treatment device or workstation has a main body 66, including a work-supporting portion 68 at the upper end thereof. The treatment fluid reservoir 38 is connected to the workstation by a liquid feed pipe 70 and a treating liquid recovery pipe 72. The pump 40*e* along the treating liquid feed channel or pipe 70 pumps treating liquid from the reservoir 38 to the workstation. The treating liquid feed pipe 70 is further provided with a main automatic valve 74 and a main manual valve 76 for adjusting the feed rate of the treating fluid, with a flow rate sensor 78 for detecting the flow rate of the treating liquid. Downstream of the main body 66 of the workstation, the treating liquid recovery channel or pipe 72 likewise communicates with the treating fluid reservoir 38. Advantageously, located along the recovery pipe 72 is a suction pump 80 for forcibly suctioning treating liquid from the treatment device main body.

As discussed below in greater detail, there is also provided a washing water feeding pipe 82 for feeding washing water to the cylinder block 20. The washing water feed pipe 82 has a downstream end connected to the jig 62 and an upstream end connected to a source of washing water (not shown). An automatic valve 84 is disposed between the source of washing water and the jig 62 for adjusting the flow rate of washing water. As will be appreciated, after washing, the washing water is passed through the recovery pipe 72. To prevent the wash water from diluting the concentration of the treating fluid, the treating fluid reservoir 38 is equipped with a concentrating device (not shown) to remove a quantity of water corresponding to the washing water flowing into the tank, by means of evaporation.

Plating Workstation

Figure 4:
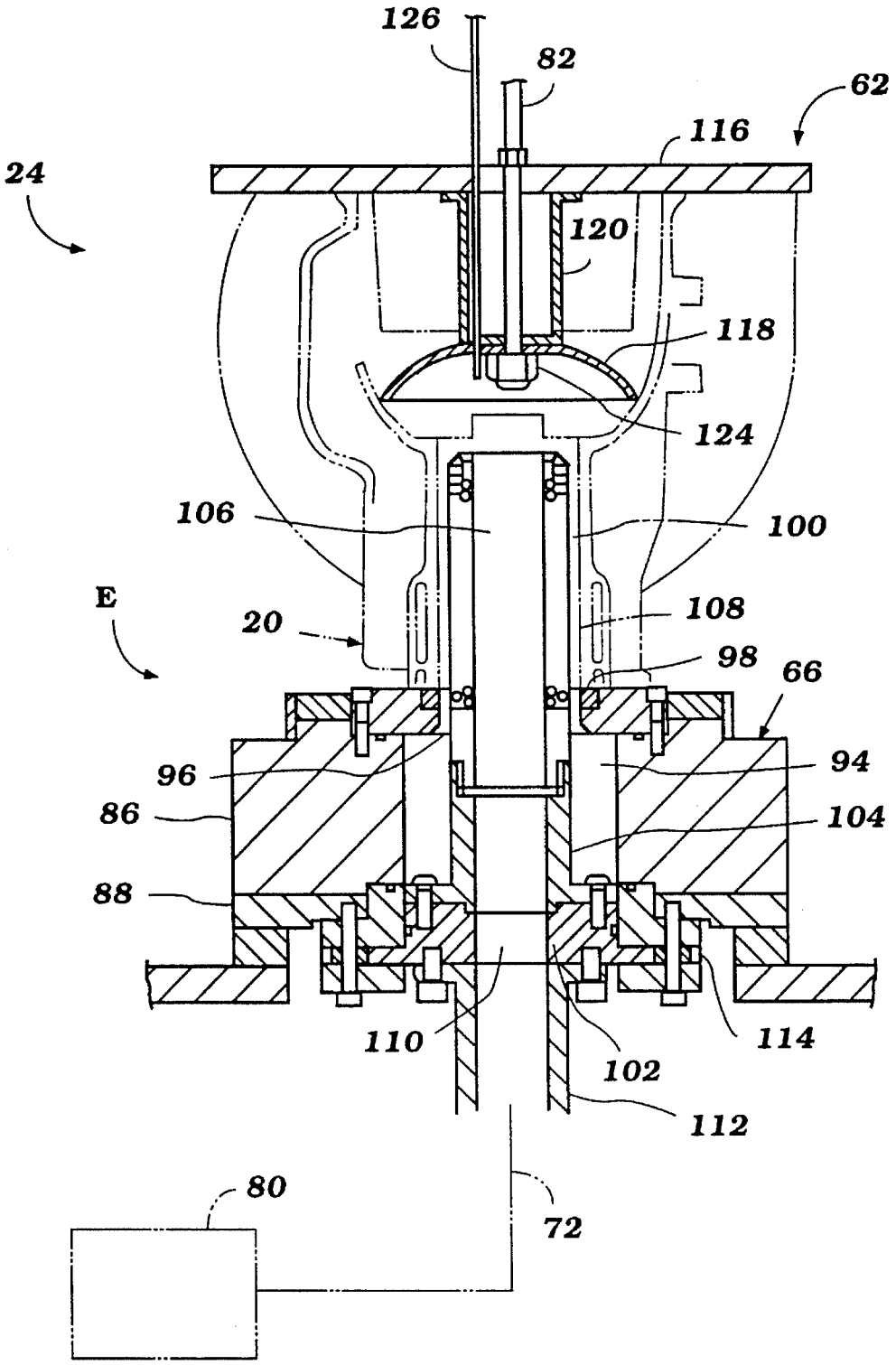
FIG. 4 is an elevational, vertical cross-sectional view showing one embodiment of a surface treatment device according to the present invention applied to a plating workstation.
Figure 5:
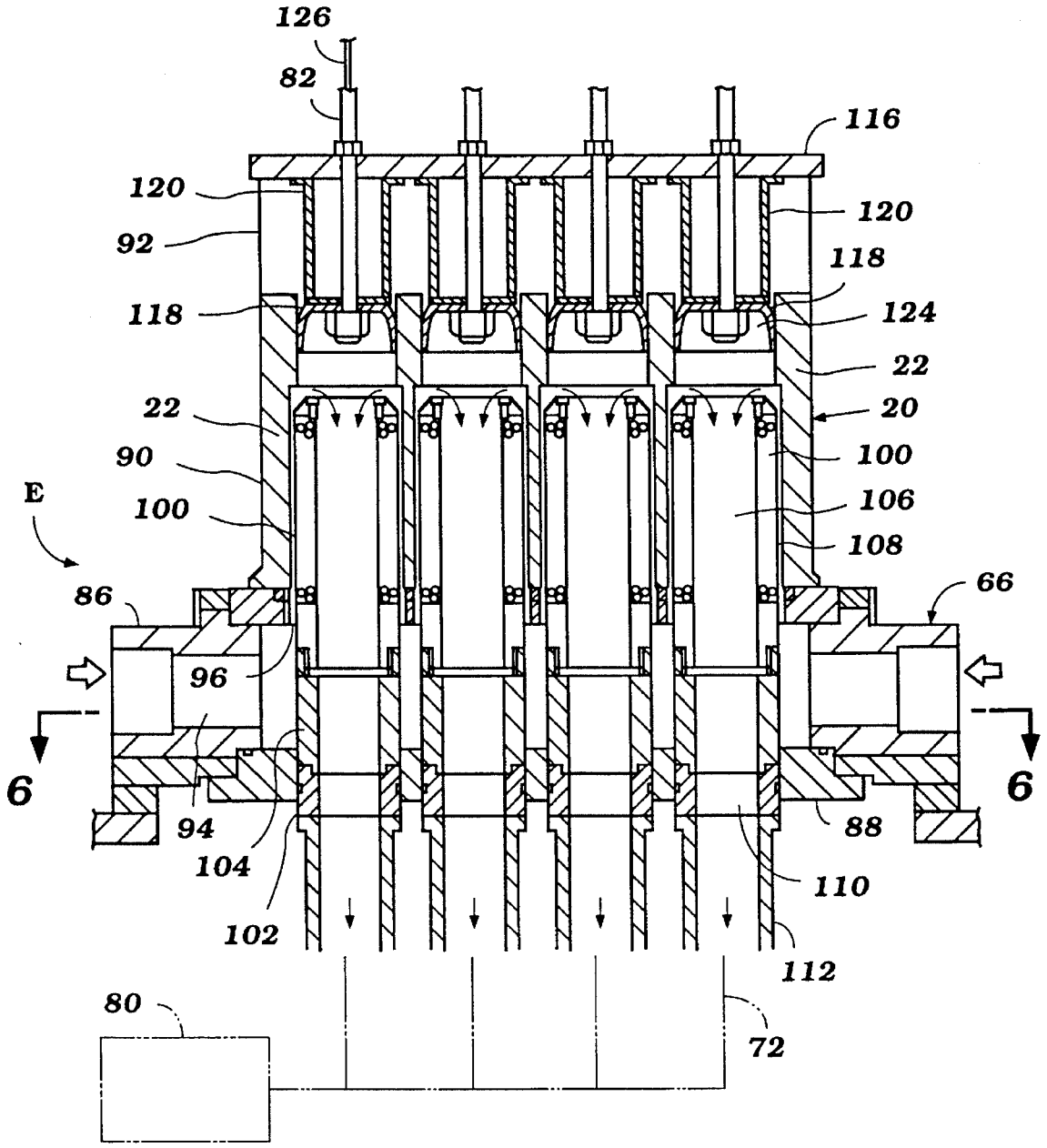
FIG. 5 is a vertical cross-sectional side view of the surface treatment device of FIG. 4.

FIGS. 4 and 5 illustrate a detailed structure of the plating workstation 24. A work support portion or supporting block 86 is mounted on a base table 88 of the workstation main body 66. The cylinder block 20 is adapted to be supported on the supporting block 86, with both open portions of each cylinder 22 maintained in a predetermined vertically oriented state. Specifically, the cylinder block 20 has a unitary structure composed of a cylinder-defining portion 90 defining four cylinders 22 and a skirt-like crankcase portion 92. The cylinder block 20 is inverted from the position it will be mounted in the automobile, and the jig 62 is connected to the upper end of the crankcase.

The supporting block 86 defines a laterally extending (in the direction along which the cylinders are arranged) treating liquid feed path 94 positioned beneath the cylinder portion 90 of the cylinder block 20. Both ends of the liquid feed path 94 are connected to the treating liquid feed pipe 70 (see FIG. 3). The support block 86 defines a series of openings 96 corresponding to the position of each of the cylinders, which is in;fluid communication with the treating liquid feed path 94. A seal portion 98 is provided around the periphery of each opening 96. Accordingly, as will be appreciated, when the cylinder block 20 is mounted on the supporting block 86, the lower end of each cylinder (head side of the cylinder) coincides with the corresponding opening 96 in the mounting block with the peripheral edges of each cylinder in sealing engagement with the seal portion 98.

The body of the workstation 24 includes an electrode 100, which also functions as a fluid passage defining member. Each of the electrodes 100 is positioned to correspond to the position of each of the cylinders 22 of the cylinder block 20. The electrodes 100 are likewise formed in a cylindrical shape and are mounted on a holder 102, which in turn is mounted on the table 88 to a mounting member 104. Each electrode 100 extends through the treating liquid feed path 94 and protrudes upward from the corresponding opening 96. Accordingly, when the cylinder block 20 is mounted on the support block 86, each of the electrodes 100 is positioned within a corresponding cylinder 22 of the cylinder block so that the upper end of each electrode is positioned adjacent to an upper end of the cylinder bore with a predetermined space being defined between the outer peripheral surface of the electrode and the inside cylindrical surface defined by the cylinder. As a result, inner and outer cylindrical passages 106, 108 are defined inside and outside each electrode. These inner and outer fluid passages 106, 108 communicate with one another at the upper ends thereof. Furthermore, the outer fluid passage 108 is in fluid communication with the treating liquid feed path 94.

Figure 6:
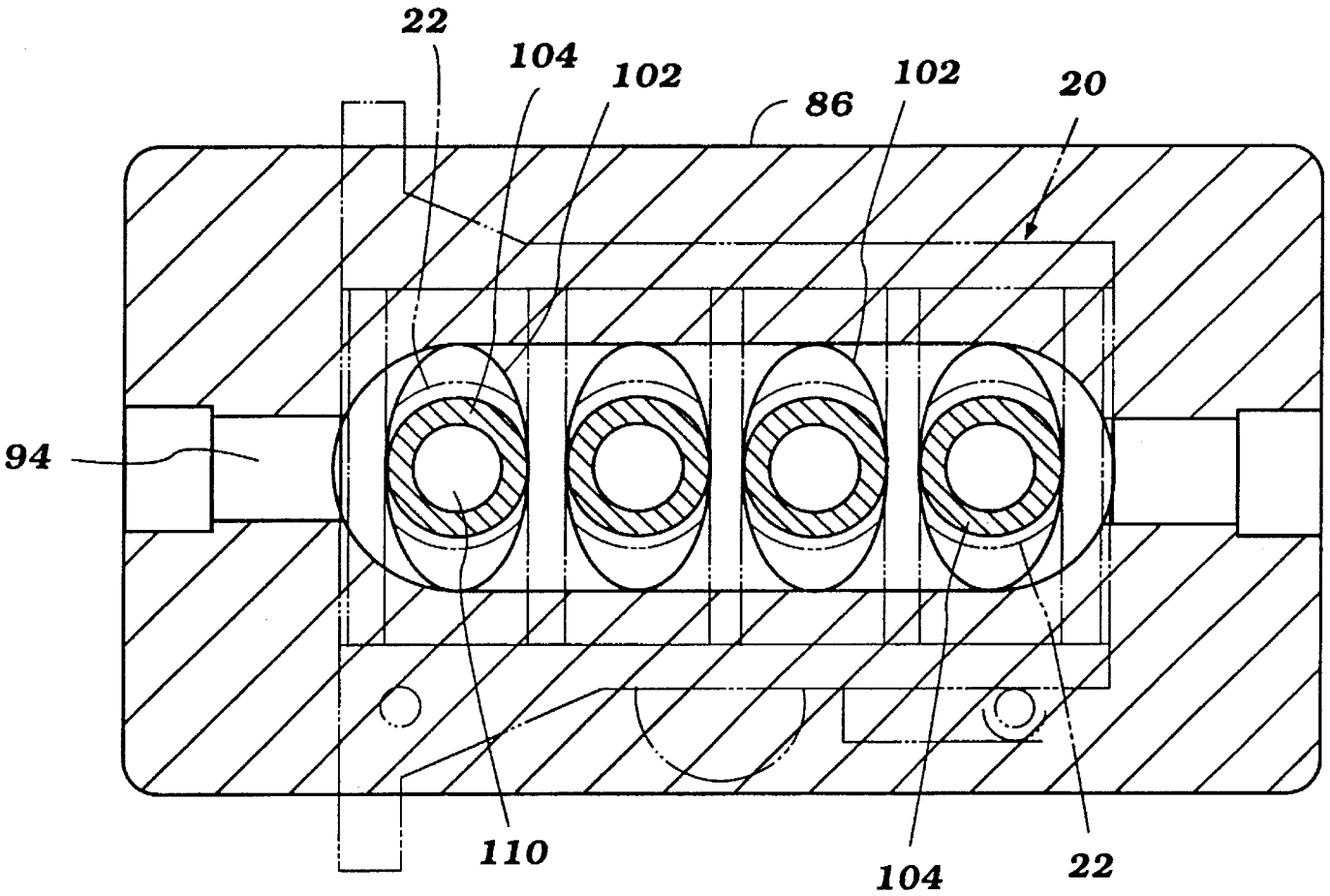
FIG. 6 is a sectional view of the surface treatment device taken along line 6—6 of FIG. 5.

Each of the holders 102 is provided with a through hole which constitutes, together with the inside face of the mounting member 104, a treating liquid discharge path 110 which is in fluid communication with the passage 106 formed within the electrode 100. Each treating liquid discharge path 110 is connected to a respective treating liquid recovery pipe 72 through a connecting pipe 112. The mounting member 104, holder 102, and connecting pipe 112 are formed of an electrically conductive material and are electrically connected to a rectifier. As will be appreciated, to properly orient the electrode, each holder 102 must be precisely positioned with respect to the corresponding cylinder 22 of the cylinder block 20. Further, the electrodes 100 are required to be electrically separated from one another. Thus, as shown in FIG. 6, each of the holders 102 is shaped into an ellipse with the long axis being oriented in a direction normal to the shorter axis and having a flange 114 extending outward from each end of the longer axis side and fixed to the base table 88 by bolts. The mounting member 104 is fixedly secured to the longer axis sides of the holder 102 by bolts.

The jig 62 connected to the cylinder block 20 is provided with a plate 116 which is in abutting engagement with an upper open portion of the cylinder block and with a cover member 118. Each cover member 118 is positioned to cover the open upper end of one of the cylinders 22. Desirably, the cover member 118 is formed of rubber or a similar material shaped in arcuate form and is mounted on the jig plate 116 by means of a bracket 120. Desirably, the peripheral edge of the cover member 118 is in close contact with the inside wall of the crankcase portion 92 and with the wall surface of a crankshaft supporting wall 122 disposed between the cylinders.

Advantageously, the cover member 118 is provided with a washing fluid inlet such as a shower nozzle 124 for spraying washing water from the water feed pipe 82 into the inside of the cylinder. Desirably, a sensor 126 is provided proximate the washing water inlet 124 to prevent the overflow of treating liquid from the cover member 118.

Figure 7:
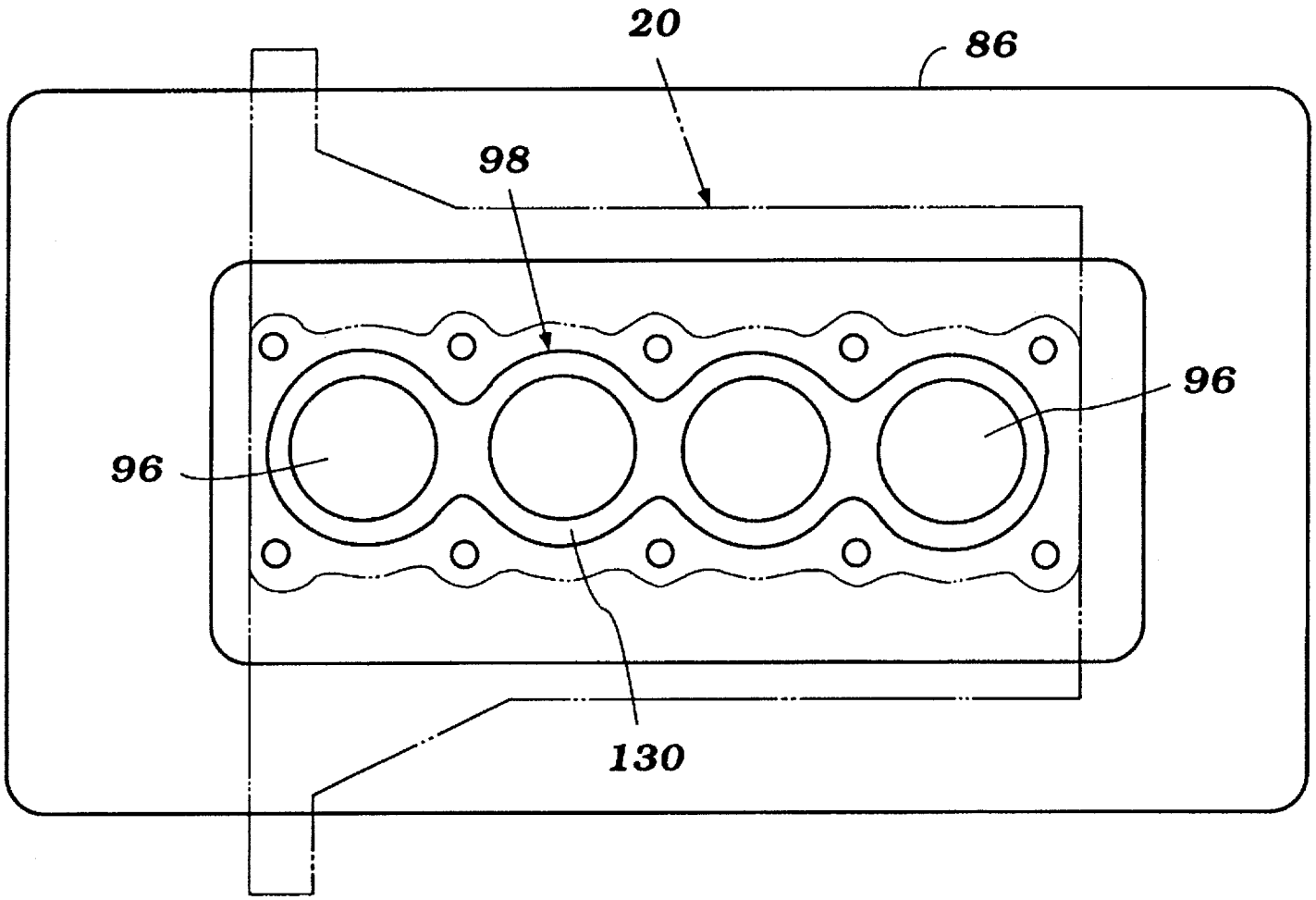
FIG. 7 is a plan view showing an embodiment of the sealing portion of the supporting block of the surface treatment device of FIG. 4.
Figure 8:
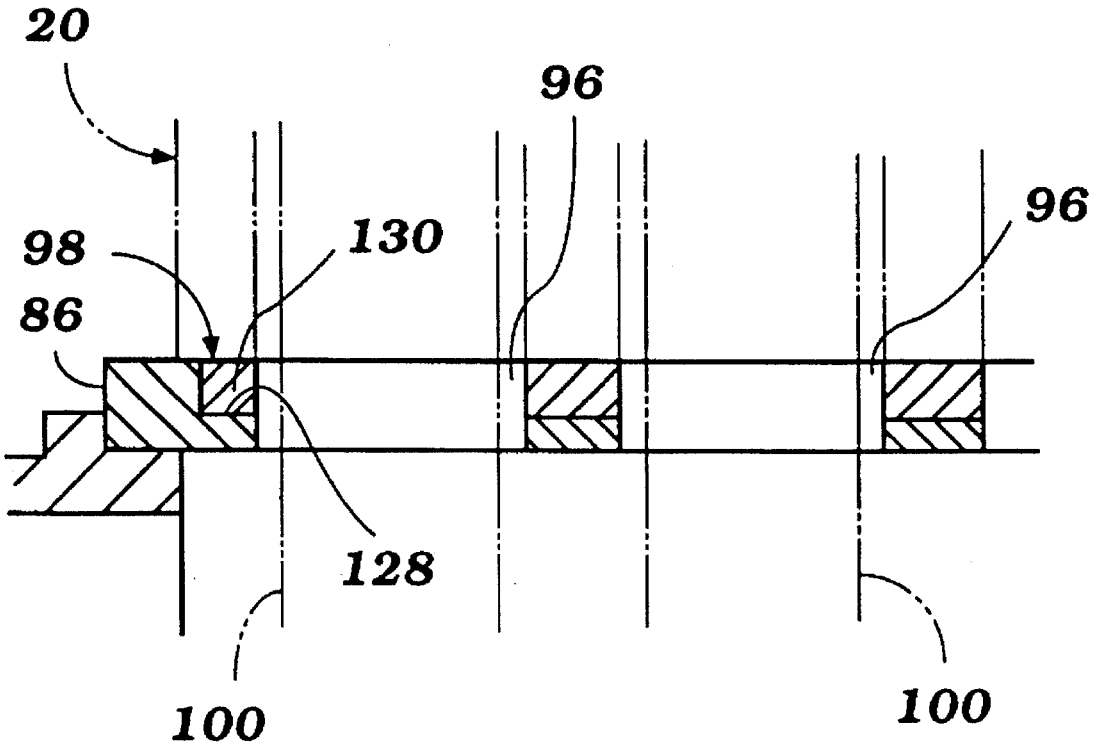
FIG. 8 is a sectional view of the sealing portion of FIG. 7.

FIGS. 7 and 8 illustrate one embodiment of the sealed portion 98 between the upper surface of the support block 86 and the lower end of the cylinder block 20. Referring to FIGS. 7 and 8, a recessed step 128 is formed around the periphery of each open portion 96 of the support block 86. A seal member 130 formed from a predetermined number of interconnected annular flat packings is fitted into the recess portion 128 to form the seal 98. The engagement of the seal member 130 with the lower end surface of the cylinder block 20 prevents leakage of treating liquid and damage to the lower end surface of the cylinder block.

Figure 9:
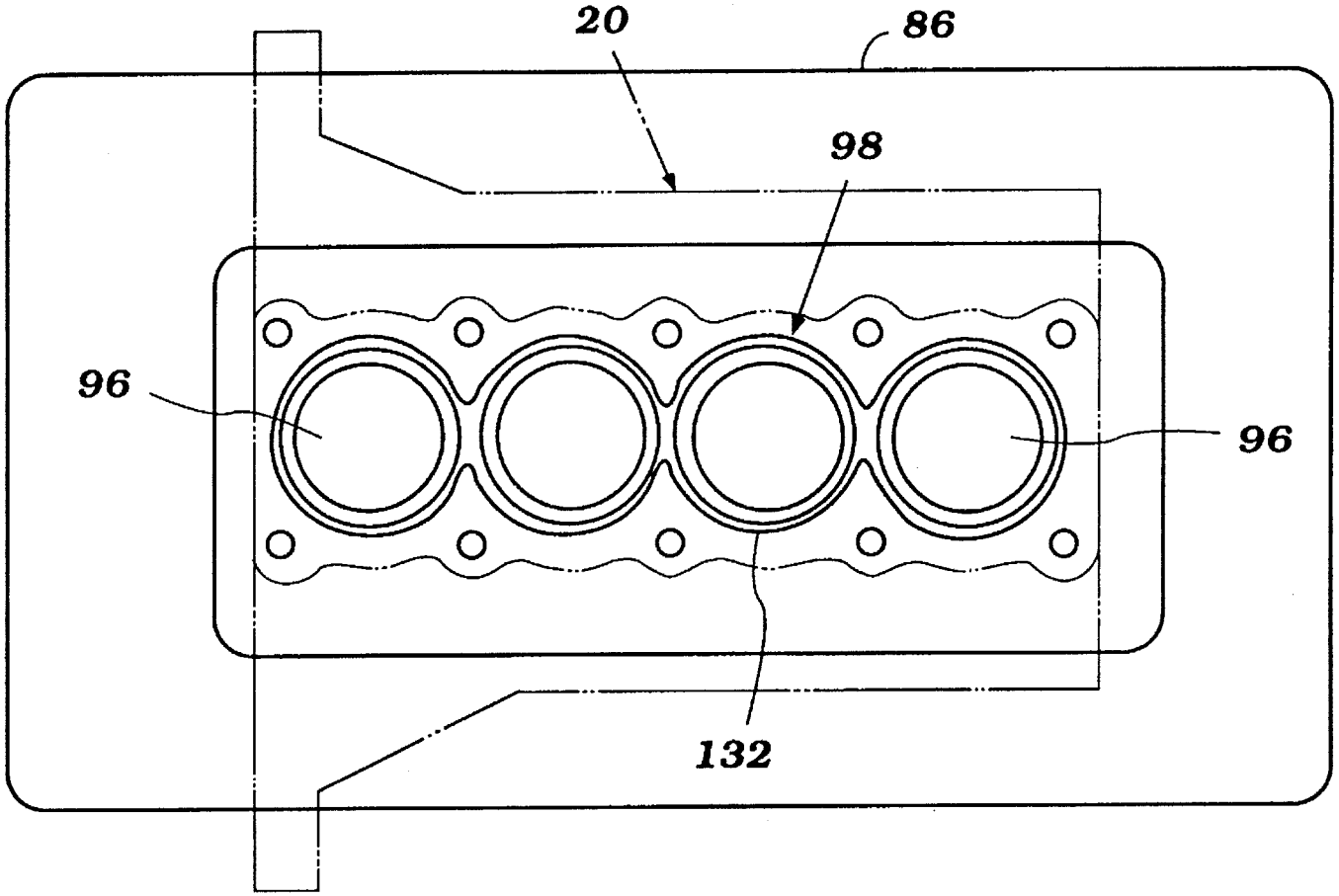
FIG. 9 is a plan view of an alternative embodiment of the sealing portion of a surface treatment device.
Figure 10:
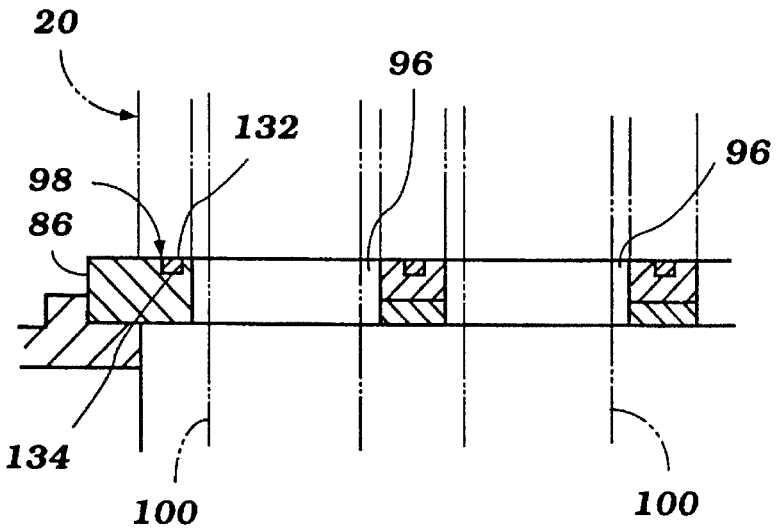
FIG. 10 is a sectional view of the sealing portion of FIG. 9.

FIGS. 9 and 10 illustrate an alternative embodiment of the seal member 98. Here, the seal member 98 is formed from a predetermined number of interconnected O-rings 132 fitted into an annular groove 134 formed around each of the openings 96 on the upper side of the support block 86. Engagement of the seal 98 and the upper surface of the support block 86 surrounding the cylinder prevents leakage of treating fluid and damage to the lower end surface of the cylinder block 20.

Operation

Initially, the cylinder block 20 and jig 62 are connected to one another so that the cover member 118 covers the upper opening of each of the cylinders 22. The assembly is then set on the supporting block 86 of the workstation body. Thereafter, the plating liquid is fed and recirculated according to the piping system shown in FIG. 3. At the same time, the electrode 100 shown in FIGS. 4 and 5 is energized to effect a high speed plating of the interior surface of each of the cylinders 22 of the cylinder block 20. That is, the plating liquid is fed from the treating liquid feed pipe 70 to the treating liquid feed path 94 in the supporting block 86 and a thin path as shown by the arrow in FIG. 5 through the passage 108 defined between the electrode 100 outer periphery and the inside surface of the cylinder 22 to the passage 106 of the inside of the electrode via the upper space of the cylinder. Through the suction force of the suction pump 80 provided in the treating liquid recovery pipe 72, the plating liquid is forcibly sucked into the recovery pipe through the passage 106 and the treating liquid discharge path 110 and then is returned to the treating liquid tank 38. While the plating liquid is recirculated in this manner, the plating liquid flows within the cylinder 22 along the inside peripheral surface of the cylinder to be plated. By establishing a voltage between the electrode 100 and the inside peripheral surface of the cylinder 22, a high speed plating is effected.

An important aspect of this invention is the provision of a suction pump 80 in the treating liquid discharge path 72, thereby preventing the overflow of plating liquid from the upper opening of the cylinder 22.

Likewise, advantageously, the use of a cover member 118 covering the upper opening of the cylinder 22 prevents the spattering of plating fluid. Since the plating liquid is sucked from the recovery line 72, the cover member 118 is not required to form a liquid tight seal with the cylinder block 20. It is sufficient that the cover member 118 simply cover the upper open portion of the cylinder 22 to prevent overflow of plating liquid when the suction pump 80 malfunctions. Desirably, the liquid level sensor 126 mounted on the cover 118 is connected to the pump 80 to likewise reduce the risk of treating fluid overflow.

Advantageously, the device of the present invention permits the washing of the plated workpieces at the plating workstation. Specifically, after the completion of the plating treatment, the feed pump **40*e* and suction pump 80 stop operating. Washing water is then fed through the feed pipe 82 from a source of washing liquid (not shown) and is sprayed through the shower nozzle 124 mounted on the cover 118 into the inside of the cylinder 22, washing the interior cylindrical surface. The washing water passes through both the treating liquid feed pipe 70 and the treating liquid recovery pipe 72 to the treating liquid reservoir 38. The concentration of treating liquid in the treating reservoir 38 is maintained constant by either removing water by evaporation during the washing operation or by spraying washing liquid into the cylinder 22** to add additional fluid. Importantly, by using-the same workstation for washing the workpieces as plating, less space is required for the overall assembly line. As conventional devices require displacing the work successively through a plurality of washing vessels disposed separately in, the plating treatment section of the assembly line, the amount of space saved is significant.

Alternative Fluid Delivery System

Figure 11:
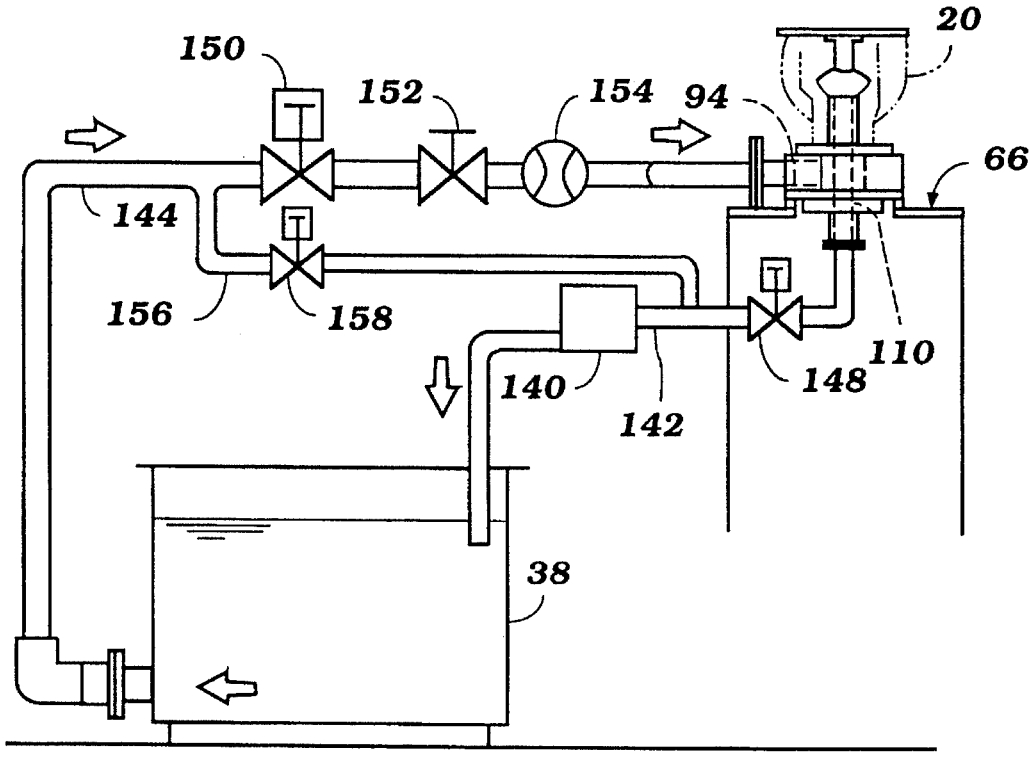
FIG. 11 is an alternative embodiment of the fluid transfer assembly of the present invention.

FIG. 11 depicts an alternative embodiment of the treating liquid feed and discharge mechanism. In the illustrated embodiment, a self-feeding-type pump 140 having high suction power is used as a suction device disposed in the liquid recovery pipe 142. Significantly, the suction provided by the pump 140 is sufficient both to generate sufficient flow rates in the recovery pipe 142, as well as the feed pipe 144 of the system. The fluid flows from the body 66 of the workstation, through the discharge path 110, through the high suction pump 140, and to the treatment fluid reservoir 38. A flow rate control valve 148 is positioned intermediate the treating liquid discharge path 110 and the high suction pump 140. The treating liquid feed pipe 144 extending between the reservoir 38 and the treating liquid feed path 94 of the workstation main body 66 is provided with an automatic valve 150, a manual valve 152, and a flow meter 154. A bypass flow path 156 is also provided directly connecting the treating liquid feed path 94 with the treating liquid recovery pipe 142. An automatic valve 158 is positioned along the bypass flow path 156 between the feed pipe 144 and the recovery pipe 142.

In operation, the treating liquid is sucked through the entire system by the high suction force of the pump 140. Advantageously since no pressure is applied to the treating liquid flow passages 106 and 108, the risk of overflow of the plating liquid from the upper openings of the cylinder 22 of the cylinder block 20 is substantially minimized. Additionally, the provision of a bypass passage 156 and an automatic valve 158 makes it possible to quickly stop the feed and discharge of the treating liquid to and from the workstation main body 66 by opening the automatic valve to permit treating liquid to flow through the bypass passage when the plating treatment is stopped.

The Pretreatment Workstation

Figure 12:
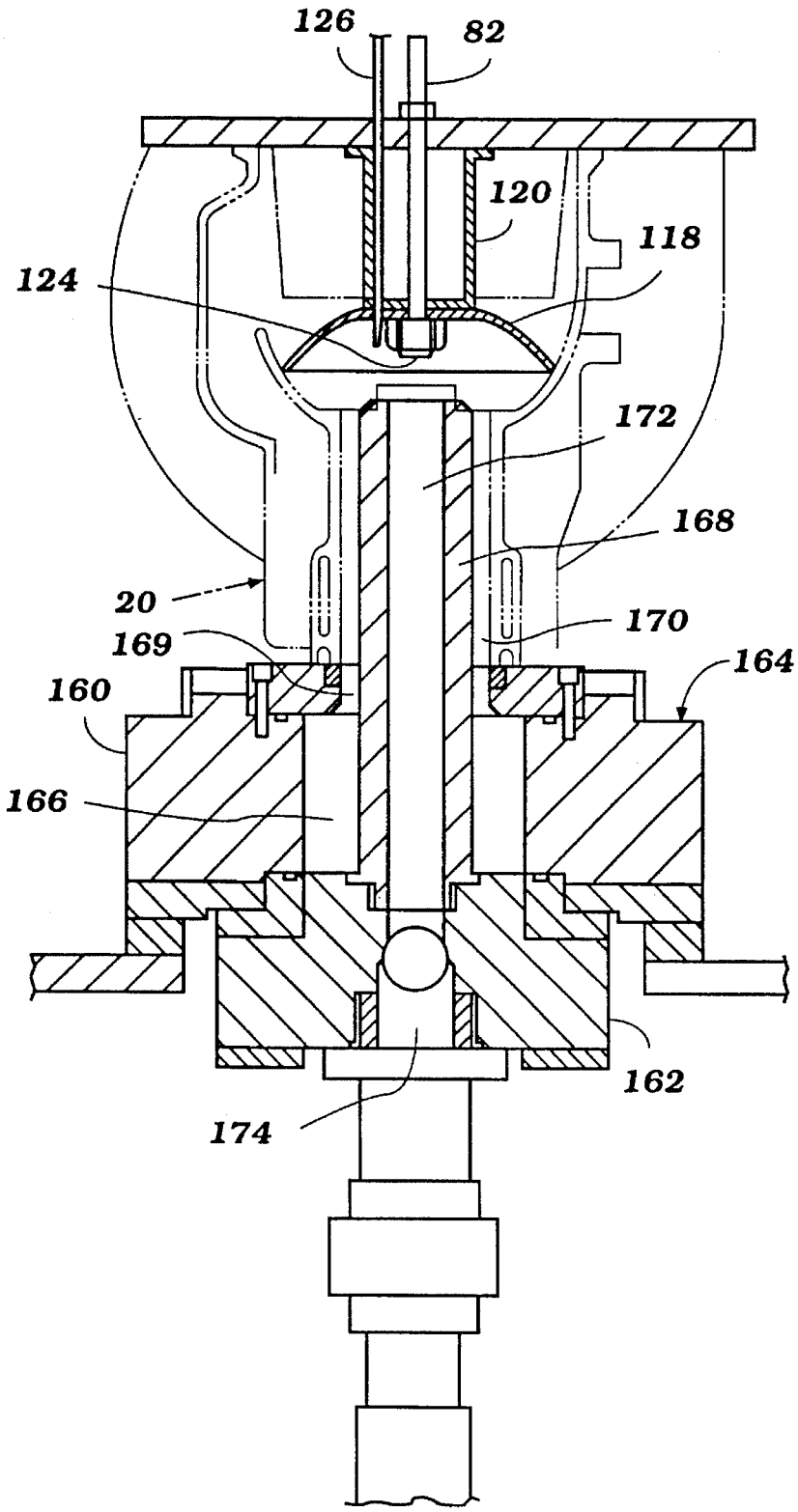
FIG. 12 is a vertical, cross-sectional view of a pretreatment workstation of the system of FIG. 1.
Figure 13:
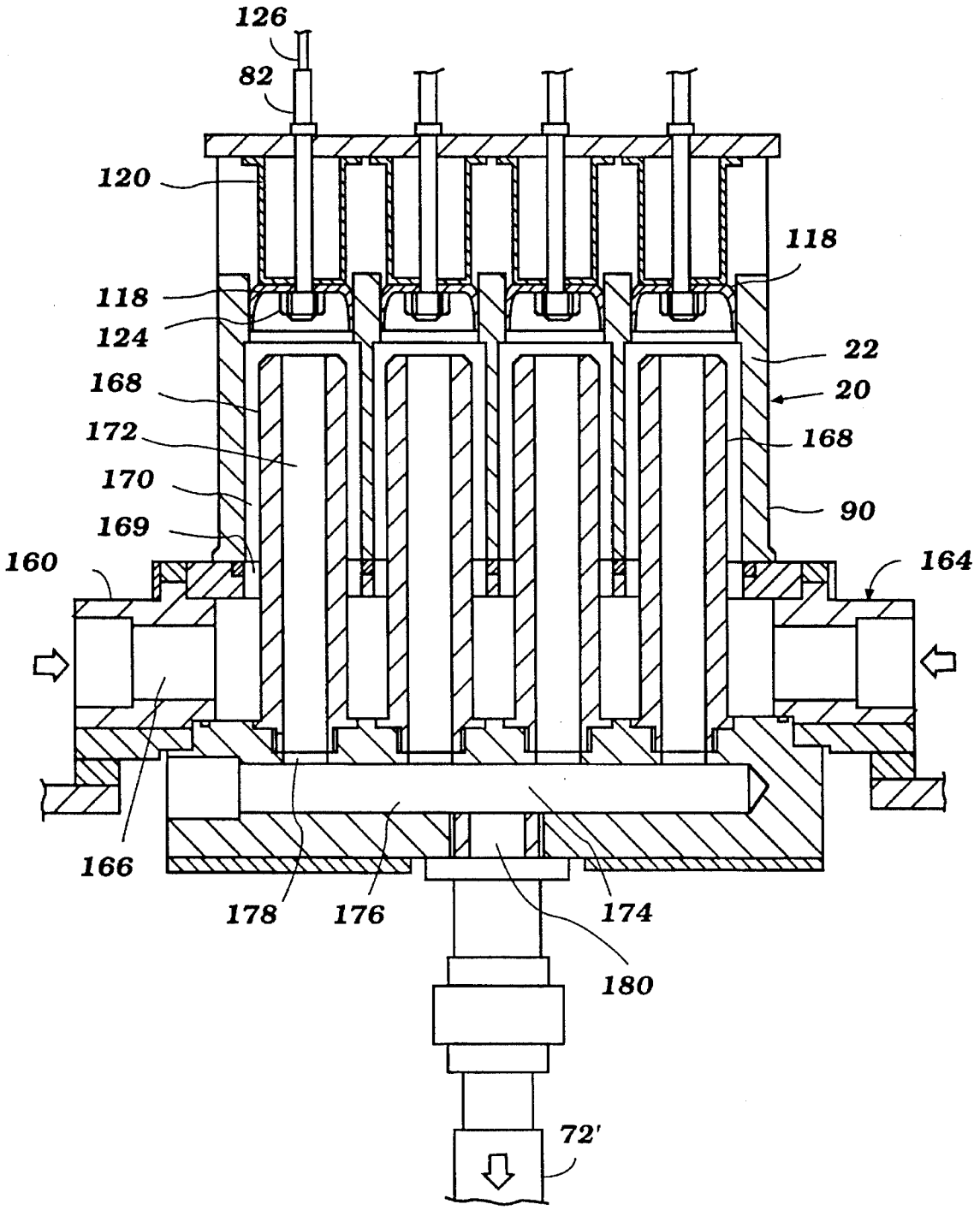
FIG. 13 is a side, cross-sectional view of the pretreatment workstation of FIG. 12.

The teachings of this embodiment are equally applicable to pretreatment workstations. For example, referring to FIGS. 12 and 13, a support block 160 may be mounted on a base table 162 of a workstation main body 164 in the same manner as previously described. The support block 160 is provided with a treating liquid feed path 166 connected to a treating liquid feed pipe (not shown). A cylindrical fluid passage-defining member 168 is disposed at a position corresponding to each of the cylinders 22 of the cylinder block 20. The fluid passage-defining member 168 may have nearly the same shape and arrangement as the electrode 100 of the plating treatment workstation E and protrudes through an opening 169. Specifically, the fluid passage-defining member 168 is inserted into each of the cylinders 22 through an opening to form outer and inner fluid passages 170, 172. This fluid passage-defining member 168 is advantageously fixed to the base table 162. The base table 162 is provided with a treating liquid,discharge path 174 which is in fluid communication with the fluid passage 172 on the inside of each of the fluid passage-defining members 168, a communication passage 176 which is in fluid communication with a corresponding port 178, and an outlet passage 180 which is in fluid communication with the communication passage and extends downward. A treating liquid recovering pipe 72' is connected to the treating liquid discharge path 174.

In operation, the cylinder block 20 is connected to the jig 62 such that the upper openings of each of the cylinders 22 is covered with the cover 118, the cylinder block and jigs are supported by the support block 160, and fluid is allowed to pass through the treating liquid feed pipe through the inner and outer fluid passages 172, 170, thereby establishing a flow of treating liquid along the inside peripheral surface of the cylinder to enable high-speed plating to be performed. Once again, after the treatment, the shower nozzle 124 mounted on the cover 118 may supply a spray of washing water to the inside of the cylinder 22 to effect washing. Accordingly, again, the present system permits the reduction in space utilized by the plating treatment line.

Due to the nature of the plating liquid, it is particularly desirable to avoid leakage of plating fluid during the plating treatment process. On the other hand, the concerns with leakage are not as great for pretreatment workstations. Accordingly, it would be possible to manufacture the piping system without a suction pump, thereby incurring a greater risk of leakage.

No Cover Embodiment

Figure 14:
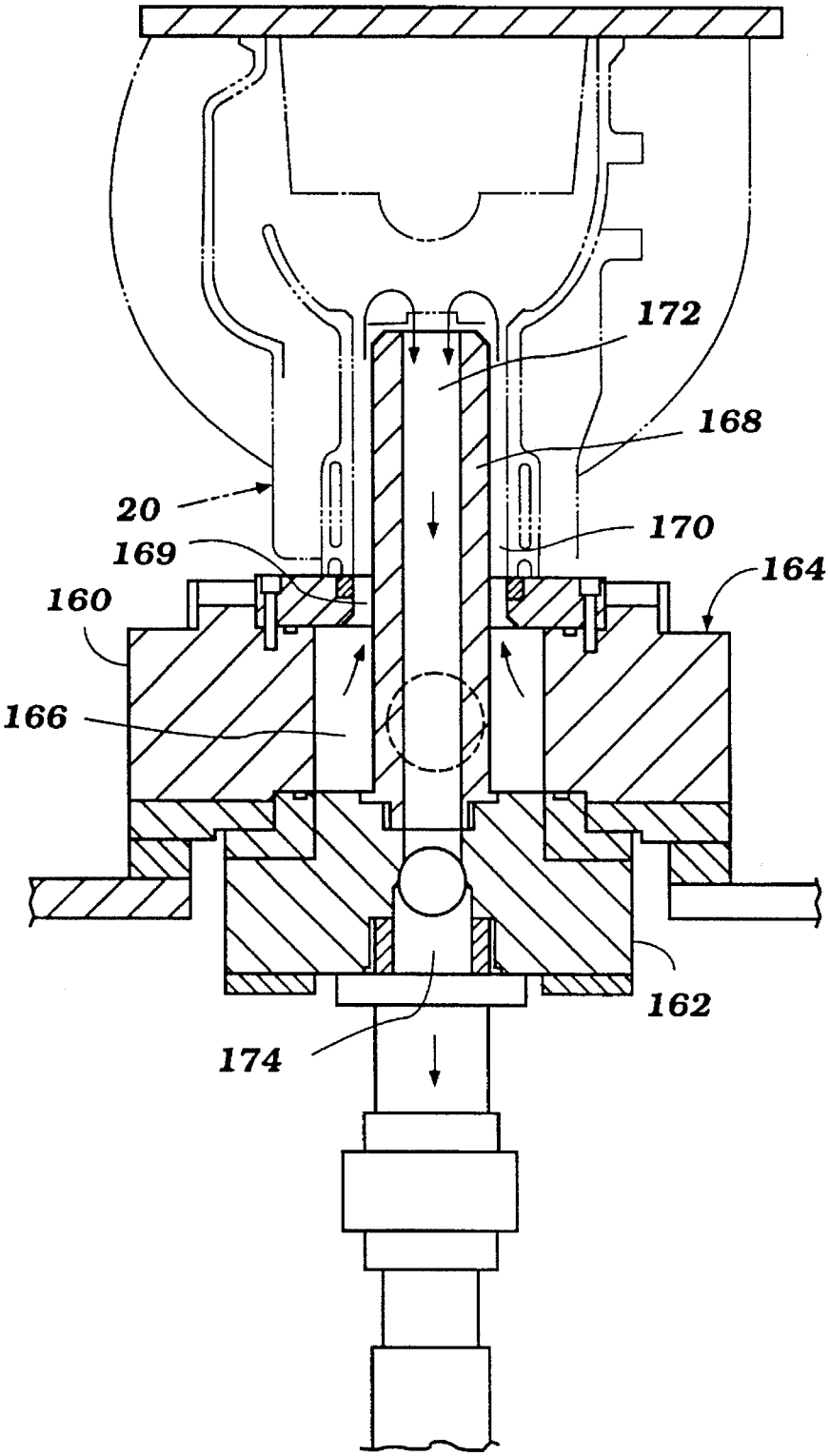
FIG. 14 is a vertical, cross-sectional front view of an alternative embodiment of the pretreatment workstation of the present invention.
Figure 15:
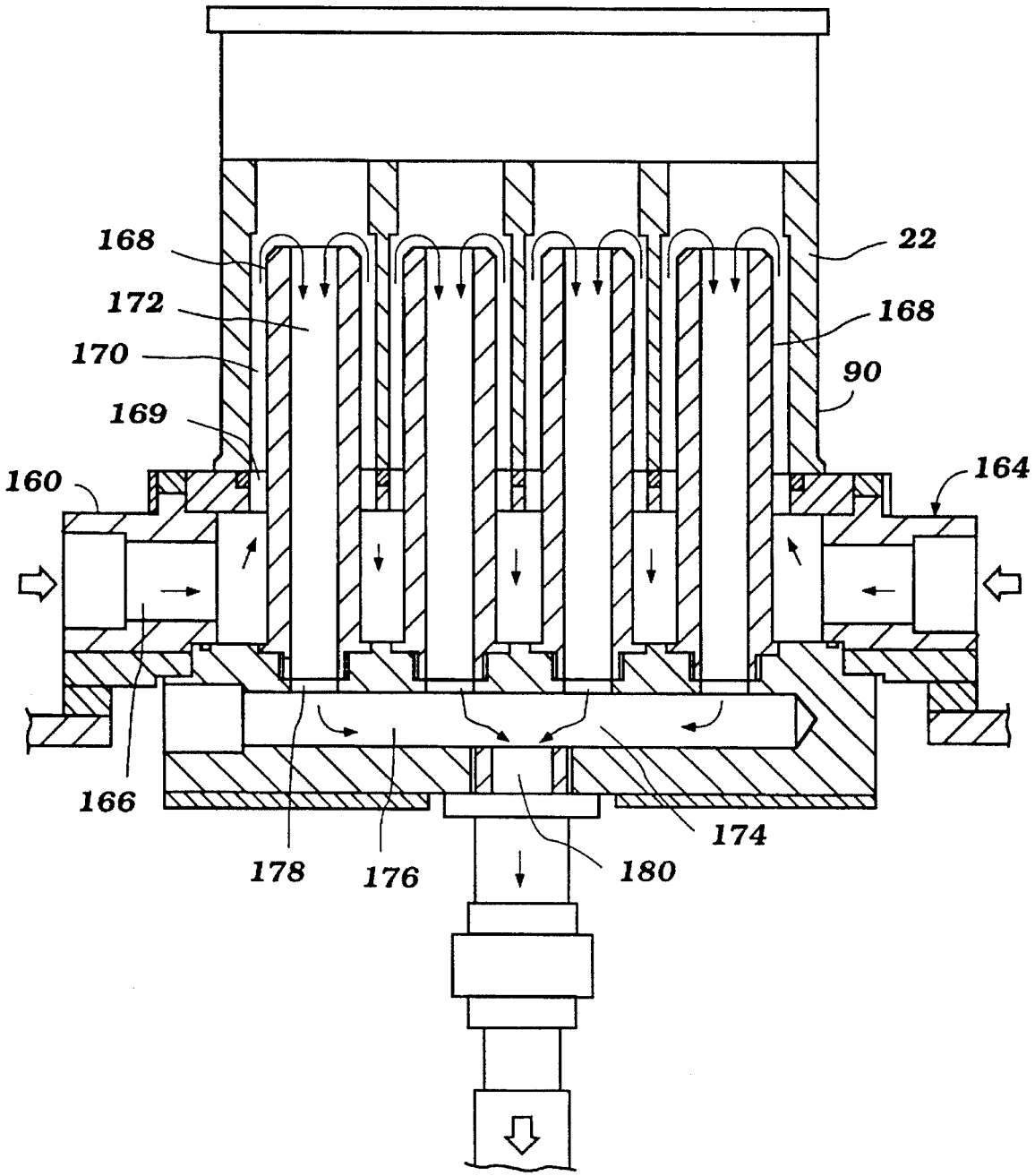
FIG. 15 is a vertical, cross-sectional side view of the pretreatment workstation of FIG. 14.

As discussed above, the jig 62 is mounted on the cylinder block 20 prior to transporting the cylinder block through the treatment line. However, this is not required. Where the jig is attached or detached between workstations, it may be desirable in pretreatment sections to omit the cover 118, as illustrated in FIGS. 14 and 15. In these Figures, the upper openings of the cylinders 22 of the cylinder block 20 are not covered, though the structure of the workstation may embody it the same as that illustrated in FIGS. 12 and 13. Specifically, the treating liquid is fed through the treating liquid feed path 166 by a treating liquid feed pump, through the fluid passage between the fluid passage-defining member 168 and the interior surface of the cylinder 22, and overflows from the upper end of the fluid passage-defining member and into the inner fluid passage 172, and thereafter is discharged to the treating liquid recovery pipe 72' through the treating liquid discharge path 174. The valves 74 and 76 (FIG. 3) provided in the treating liquid feed and discharge system control the feed rate of the treating liquid, thereby maintaining the feed rate of the treating liquid to prevent excessive spillage.

Figure 16:
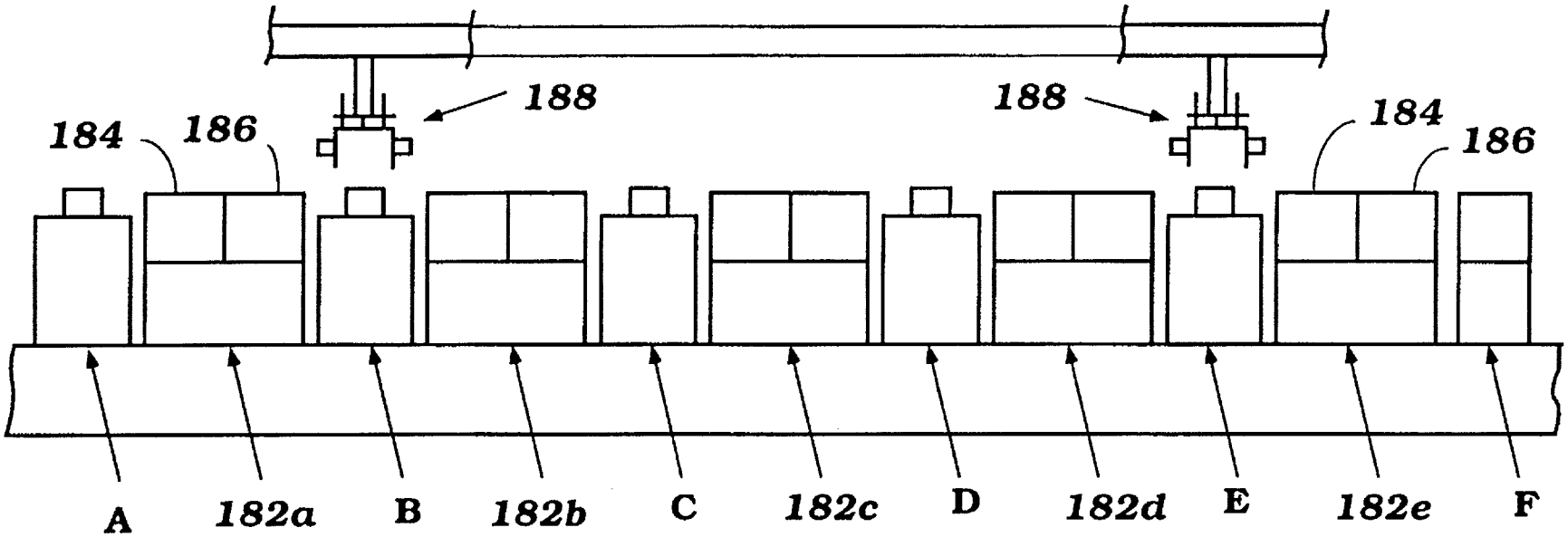
FIG. 16 is a schematic elevational view showing another embodiment of the plating treatment system of the present invention.

Naturally, as illustrated in FIG. 16, it would be possible to eliminate the washing water outlet 124 mounted on the transferring jig 62 and provide for separate washing sections 182*a–e*, each including a recovering vessel 184 and a washing vessel 186. These washing sections would then be disposed between each respective adjacent treatment workstation A–E and between the plating treatment section E and the drying section F.

Figure 17:
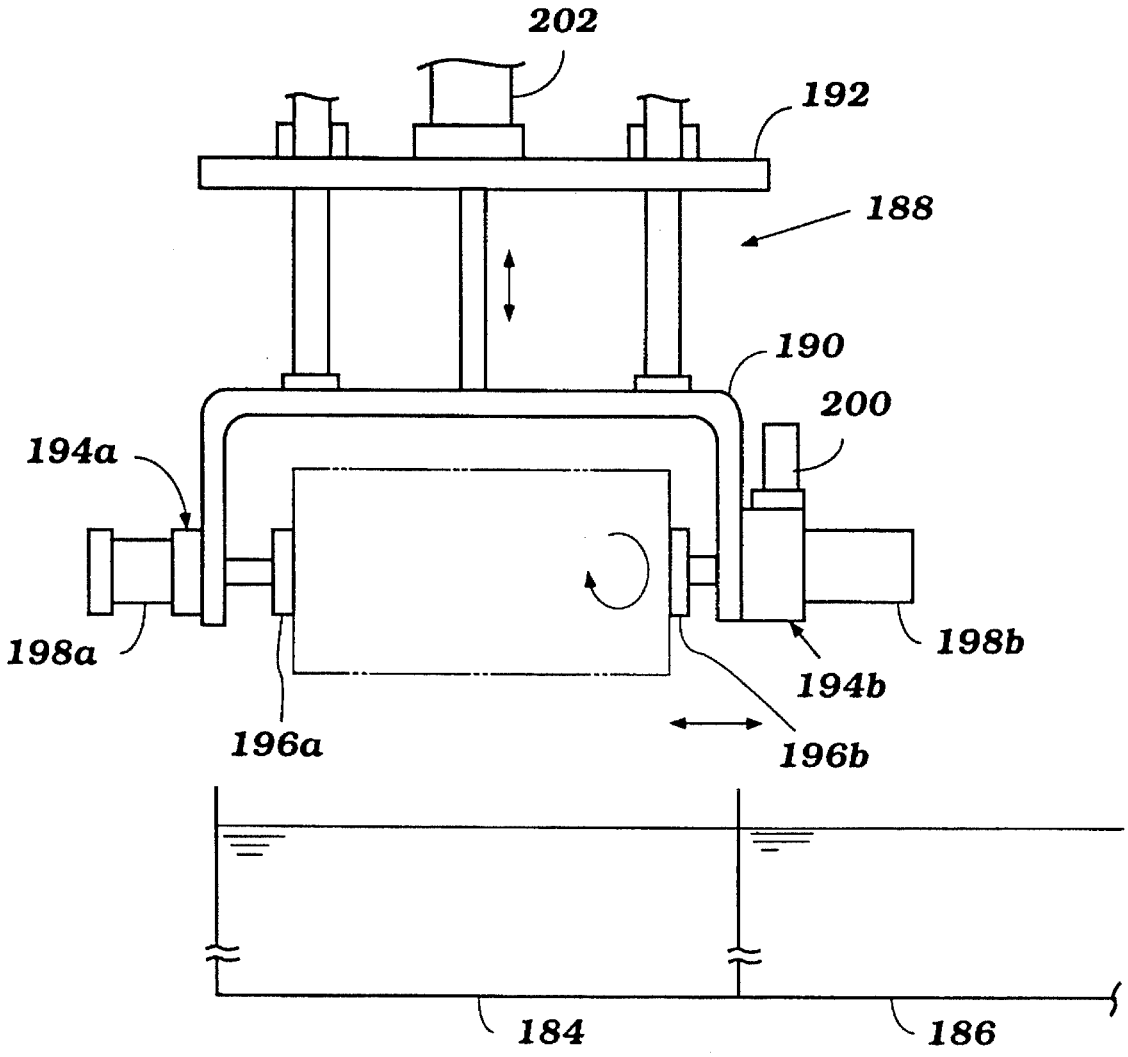
FIG. 17 is an alternative embodiment of the workpiece transfer device of the system of the present invention.

In the embodiment illustrated in FIG. 16, the transferring jig 62 is eliminated through the use of a modified transfer device 188, illustrated in greater detail in FIG. 17. The work transfer device 188 is movable along the transfer line and has a frame 190 vertically movably supported on a support section 192. A pair of left and right chuck mechanisms 194*a*, 194*b* are mounted to the frame 190. The chuck mechanisms 194*a,b* have work chucks 196*a*, 196*b* capable of protruding and retracting at the opposite sides of the frame 190 and air cylinders 198*a*, 198*b* for driving the work chucks for clamping. By operation of the air cylinders 198*a,b*, the cylinder block 20 is clamped from both sides with the work chucks 196*a,b*. The chuck mechanisms 194*a,b* are each rotatably mounted on the frame 190 and are rotatable through an angle of 180 degrees by operation of an air cylinder 200 through a rack and pinion (not shown). The frame is likewise movable up and down by means of an air cylinder 202.

The modified work transfer device 188 eliminates the need for a transfer jig 62 and permits the elimination of the jig mounting and dismounting workstations.

In the recovering 184 and washing vessels 186, the cylinder block 20 is moved between a work supporting station (not shown) movably mounted with respect to the vessels and the work transfer device 188. When the cylinder block 20 is complicated in shape, however, the amount of water taken from the vessels 184, 186 tends to increase. Advantageously, however, the air cylinder 200 can be used to rotate the chuck mechanisms 194*a,b* and the cylinder block clamped therein through 180 degrees to return much of the lost water to the vessels 184, 186, thereby minimizing the loss of water.

The system, assembly, workstation, and method of the present invention are desirably used in connection with an improved plating liquid in accordance with various process parameters, the details of which are set forth in a U.S. patent application entitled "Plating Liquid, Plating Method, and Engine Cylinder Having Plated Interior Surface," serial number unknown, filed on even date herewith (claiming priority from Japanese Patent Application No. 218753, filed Sep. 2, 1993) which is hereby incorporated herein by reference. Further, the systems, assembly, workstation, and method of the present invention may also be used in connection with certain modifications, the details of which are set forth in a U.S. patent application entitled "Surface Treatment Device," serial number unknown, filed on even date herewith (claiming priority from Japanese Patent Application No. 218754, filed Sep. 2, 1993), which is also hereby incorporated herein by reference.

It will be understood by those of skill in the art that numerous variations and modifications can be made without departing from the spirit and scope of the present invention. Therefore, it should be clearly understood that the forms of the present invention are illustrative only and are not intended to limit the scope of the present invention.

We claim:

1. An assembly for treating an interior surface of a workpiece, wherein said interior surface forms a first opening and a second opening, comprising a body defining a support to which a workpiece is mountable in an upright position by attaching a first opening portion of said workpiece to said support, said support having an opening so as to fit said first opening of said workpiece to said opening of said support when said workpiece is mounted on said support; a hollow member defining a fluid passage for treating liquid to flow inside and outside said hollow member through an opening provided at the upper end of said hollow member, said hollow member protruding from said support through said opening of said support and occupying the interior of said workpiece when said workpiece is mounted on said support, up to the proximity of the second opening of said workpiece, so that said treating liquid is allowed to flow between the interior surface of said workpiece and said hollow member and inside said hollow member when said workpiece is mounted on said support, said fluid passage defining a treating liquid feed end and a treating liquid discharge end; a removable cover to said second opening of said workpiece, said cover not being connected to said member; a treating liquid feed channel connected to said treating liquid feed end of said member; a treating liquid discharge channel connected to said treating liquid discharge end of said member; a source of pressure communicating with one of said feed channel and said discharge channel to circulate liquid within said assembly; and a washing fluid inlet communicating with said fluid passage.

2. The assembly of claim 1, further comprising a sealing surface connected to said body to form a seal around said first opening when said workpiece is secured to said support.

3. The assembly of claim 1, wherein said member comprises an electrode.

4. The assembly of claim 1, wherein said washing fluid inlet is provided in said cover in a position to direct wash water against said interior surface of said workpiece when said workpiece is mounted on said support.

5. The assembly of claim 1, wherein said source of pressure is a feed pump on said treating liquid feed channel to exert positive pressure on treating liquid within said treating liquid feed channel.

6. The assembly of claim 1, wherein said source of pressure is a suction pump on said treating liquid discharge channel to exert suction on liquid within said treating liquid discharge channel.

7. The assembly of claim 1, further comprising a bypass channel connecting said feed channel and said discharge channel.

8. The assembly of claim 1, further comprising a treating fluid reservoir connected to said treating liquid feed channel and said treating liquid discharge channel.

9. The assembly of claim 8, further comprising a treating fluid concentrator to maintain the concentration of treatment fluid in said reservoir.

10. The assembly of claim 1, wherein said cover is provided with a sensor to sense the treating liquid reaching said cover so as to prevent overflow of the treating liquid from said second opening of said workpiece.

11. An assembly for treating an interior surface of a workpiece, wherein said interior surface forms a first opening and a second opening, comprising plural treatment ports, each treatment port designated for different treatments, wherein at least one treatment port comprises a body defining a support to which a workpiece is mountable in an upright position by attaching a first opening portion of said workpiece to said support, said support having an opening so as to fit said first opening of said workpiece to said opening of said support when said workpiece is mounted on said support; a hollow member defining a fluid passage for treating liquid to flow inside and outside said hollow member through an opening provided at the upper end of said hollow member, said hollow member protruding from said support through said opening of said support and occupying the interior of said workpiece when said workpiece is mounted on said support, up to the proximity of the second opening of said workpiece, so that said treating liquid is allowed to flow between the interior surface of said workpiece and said hollow member and inside said hollow member when said workpiece is mounted on said support, said fluid passage defining a treating liquid feed end and a treating liquid discharge end; a removable cover to said second opening of said workpiece, said cover not being connected to said member; a treating liquid feed channel connected to said treating liquid feed end of said member; a treating liquid discharge channel connected to said treating liquid discharge end of said member; a source of pressure communicating with one of said feed channel and said discharge channel to circulate liquid within said assembly; and a washing fluid inlet communicating with said fluid passage; and a transporting device for transporting said workpiece from one treatment port to another treatment port after treatment at each treatment port.

12. The assembly of claim 11, wherein said plural treatment ports comprise a treatment port for a degreasing treatment, a treatment port for alkali etching treatment, a treatment port for mixed acid etching treatment, a treatment port for alumite-forming treatment, and a treatment port for plating treatment.

13. The assembly of claim 12, wherein, in said plating treatment port, said member comprises an electrode.

14. The assembly of claim 12, wherein, in each treatment port, said washing fluid inlet is provided in said cover in a position to direct wash water against said interior surface of said workpiece when said workpiece is mounted on said support.

15. The assembly of claim 14, each treatment port further comprising a treating fluid reservoir connected to said treating liquid feed channel and said treating liquid discharge channel.

16. The assembly of claim 15, each treatment port further comprising a treating fluid concentrator to maintain the concentration of treatment fluid in said reservoir.

17. The assembly of claim 12, each treatment port further comprising a bypass channel connecting said feed channel and said discharge channel.

* * * * *